United States Patent [19]

Chao

[11] Patent Number: 4,749,104

[45] Date of Patent: Jun. 7, 1988

[54] MULTI-PURPOSE CLEANSING LIQUID DISPENSER

[76] Inventor: Hsun W. Chao, 11F., No. 703, Chung Cheng Road, Shih Lin, Taipei City, Taiwan

[21] Appl. No.: 96,438

[22] Filed: Sep. 14, 1987

[51] Int. Cl.[4] ..... B67D 5/06; A63H 33/26

[52] U.S. Cl. ..... 222/78; 222/181; 446/231

[58] Field of Search ..... 222/78, 180–181, 222/185, 192; 446/61–62, 93, 231; 248/206.2, 206.3

[56] References Cited

U.S. PATENT DOCUMENTS

| | | | |
|---|---|---|---|
| 2,364,326 | 12/1944 | Stephens | 222/181 X |
| 2,689,668 | 9/1954 | Hexel | 222/78 X |
| 2,765,582 | 10/1956 | Hurtado | 446/62 |
| 2,930,064 | 3/1960 | Corbino | 222/100 X |
| 3,086,317 | 4/1963 | Quercetti | 446/231 X |
| 3,407,939 | 10/1968 | Villar-Kelly | 248/206.3 X |
| 3,623,638 | 11/1971 | Henning et al. | 222/78 |
| 3,916,560 | 11/1975 | Becker | 446/62 |
| 4,073,397 | 2/1978 | Snodgrass | 222/78 X |
| 4,085,867 | 4/1978 | Heller | 222/181 |

FOREIGN PATENT DOCUMENTS

| | | | |
|---|---|---|---|
| 738423 | 10/1955 | United Kingdom | 446/93 |

*Primary Examiner*—Michael S. Huppert
*Attorney, Agent, or Firm*—Browdy and Neimark

[57] ABSTRACT

A cleansing liquid dispenser which can alternately be used as a toy plane or toy rocket or serve as a piggy bank when the cleanser is completely used up. The dispenser comprises a cylindrical main body having an opening for cleansing liquid and a plurality of evenly spaced vertically oriented upper and lower brackets on its upper and lower outer circumference respectively. A conical top cover frictionally engages with a circular seat on the top of the main body. The dispenser is supported by a suction cup which secures the dispenser to a wall. Three or four toy tail fins are respectively engageable with three or four lower brackets and two toy wings are respectively engageable with the upper brackets so as to respectively form either a toy plane or a toy rocket.

1 Claim, 5 Drawing Sheets

MULTI-PURPOSE CLEANSING LIQUID DISPENSER

BACKGROUND OF THE INVENTION

This invention relates to a dispenser for liquid cleansers and the like which can be easily converted into a toy device or a piggy bank for children when the liquid cleanser therein is used up.

In the past, liquid cleanser dispensers were used only for dispensing liquid cleansers, and afterwards were usually thrown away. They were not usable for any purpose other than dispensing the liquid contained therein. As such, conventional containers were usually disposed of immediately after use.

It is the purpose of the present invention, therefore, to mitigate and/or obviate the above-mentioned drawbacks in the manner set forth in the detailed description of the preferred embodiment.

SUMMARY OF THE INVENTION

The present invention relates to a multi-purpose cleansing liquid dispenser comprising:

(A) a substantially cylindrical main body having a gradually narrowing lower neck on the lower end thereof with an opening for cleansing liquid thereon; said main body having a plurality of evenly spaced vertically oriented lower brackets on a lower outer circumference thereof; at least two upper brackets on an upper outer circumference of said main body; a suction cup bracket being set evenly between two of said upper brackets;

(B) a conical top cover; said top cover frictionally engaging with a circular seat on the top of said main body;

(C) a suction cup which engages with the suction cup bracket of the main body; said suction cup securing said multi-purpose cleansing dispenser to a wall or the like;

(D) three or four toy tail fins which are respectively engageable with three or four lower brackets so as to respectively partially form either a toy plane or a toy rocket; and (E) two toy wings which are respectively engageable with the upper brackets so as to partially form a toy plane.

A primary objective of the present invention is to provide a dispenser for liquid cleansers and the like which can be used as a toy airplane or toy rocket after the cleanser is completely used up.

Another objective of the present invention is to provide a dispenser for liquid cleansers and the like which has a coin slot on a top surface thereof so that it can alternately serve as a piggy bank when the cleanser is completely used up.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
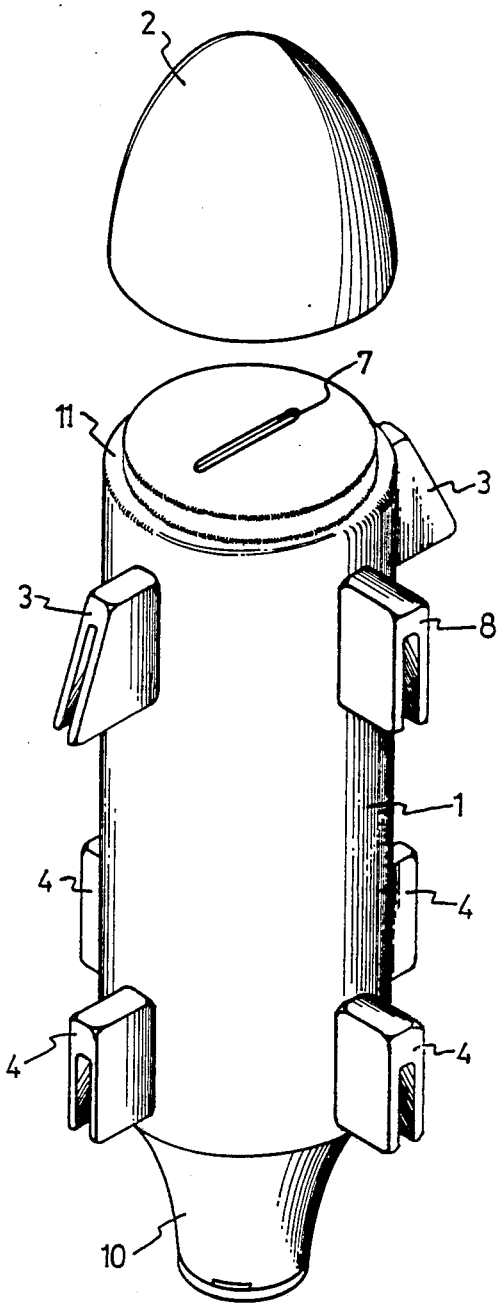
FIG. 1 is a perspective view of a cleansing liquid dispenser in accordance with the present invention, with the top cover removed.

Referring to FIG. 1, it can be seen that the present invention comprises a substantially cylindrical main body 1, a conical top cover 2, a plurality of upper brackets 3, a suction cup bracket 8, and a plurality of lower brackets 4. The lower end of the main body 1 of course has an opening through which liquid cleanser or the like is dispensed. This opening is on a lower neck 10, which gradually becomes more and more narrow (i.e. has a smaller and smaller diameter). A coin slot 7 on the top surface of the main body 1 allows air to come into the main body 1 as the liquid cleanser is dispensed, thereby facilitating the flow of liquid out of the main body 1. Without some sort of slot or hole, such as the coin slot 7, a vacuum would be created as the liquid cleanser was being dispensed. This vacuum would obviously hinder liquid substances from flowing out of the main body 1, since the natural direction of flow is always from higher pressure (i.e. atmospheric pressure) to lower pressure (i.e. the vacuum which would be created). Ordinarily, the inner lower diameter of the conical top cover 2 fits onto and frictionally engages with the circular seat 11 on the top of the main body 1 so as to be secured thereon.

From FIG. 1, it can also be seen that there is a suction cup bracket 8 on the upper part of the main body 1. Further referring to FIG. 2, it can be seen that a suction cup 9 engages with and is supported by the suction cup bracket 8. This suction cup 9 is stuck up on a wall or the like, as shown in FIG. 2, to support the liquid dispenser of the present invention.

Figure 2:
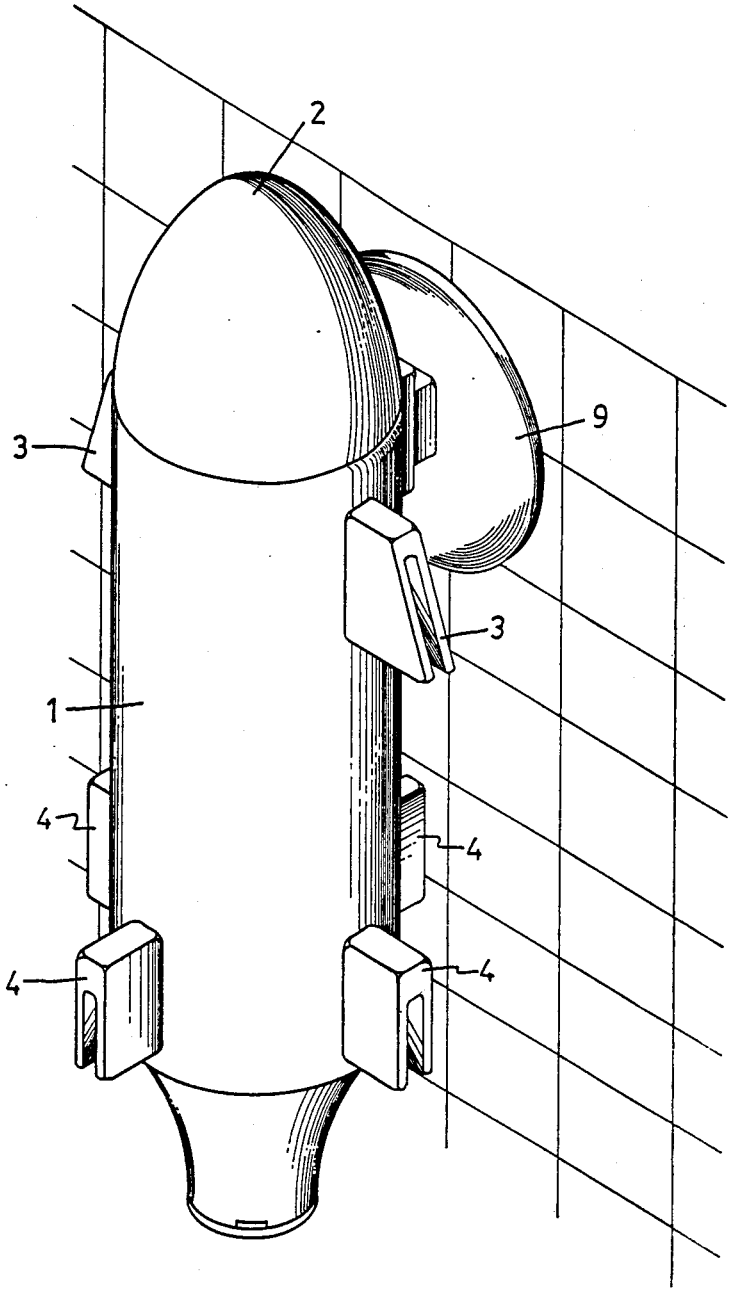
FIG. 2 is a working view of a cleansing liquid dispenser in accordance with the present invention in working position and mounted to a wall with suction cups.
Figure 3:
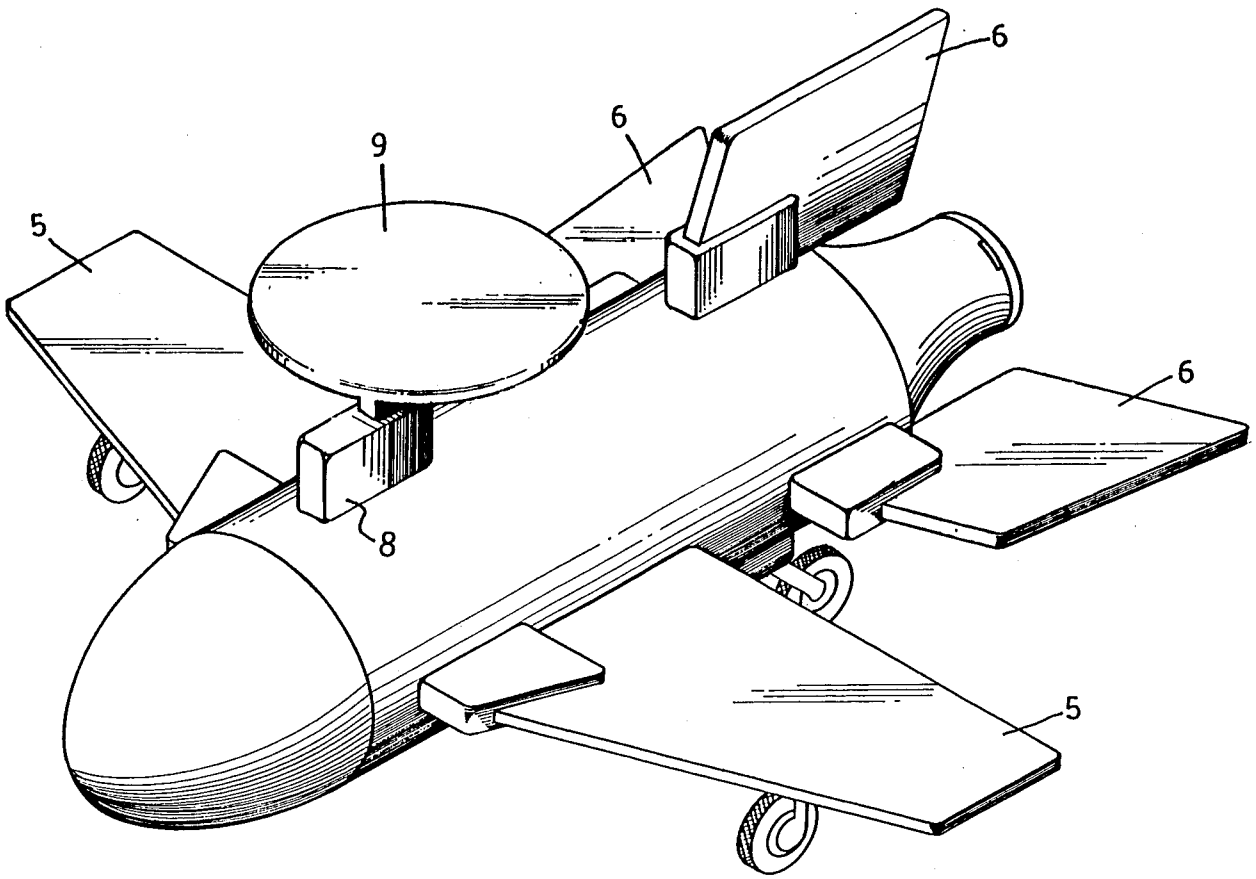
FIG. 3 is a perspective view of a toy airplane constructed from a cleansing liquid dispenser in accordance with the present invention.

Still referring to FIG. 2, it can be seen that the main body 1 also has at least two upper brackets 3 on an upper outer circumference thereof and four evenly spaced, vertically oriented lower brackets 4 on a lower outer circumference thereof. While the cleansing liquid dispenser is still being used to dispense cleansing liquids, the brackets have no functional value. However, when the cleansing liquid is completely used up, the dispenser can be rinsed off so as to get off any remaining cleanser or the like and by engaging two toy wings 5 and three toy tail fins 6 into the upper brackets 3 and lower brackets 4, respectively, the cleansing liquid dispenser can be converted into a toy airplane. The suction cup 9 and its brackets 8 resemble the radar dish of an Airborne Warning And Control System (AWACS) airplane. The wings can optionally have wheels thereon as shown in FIG. 3.

Figure 4:
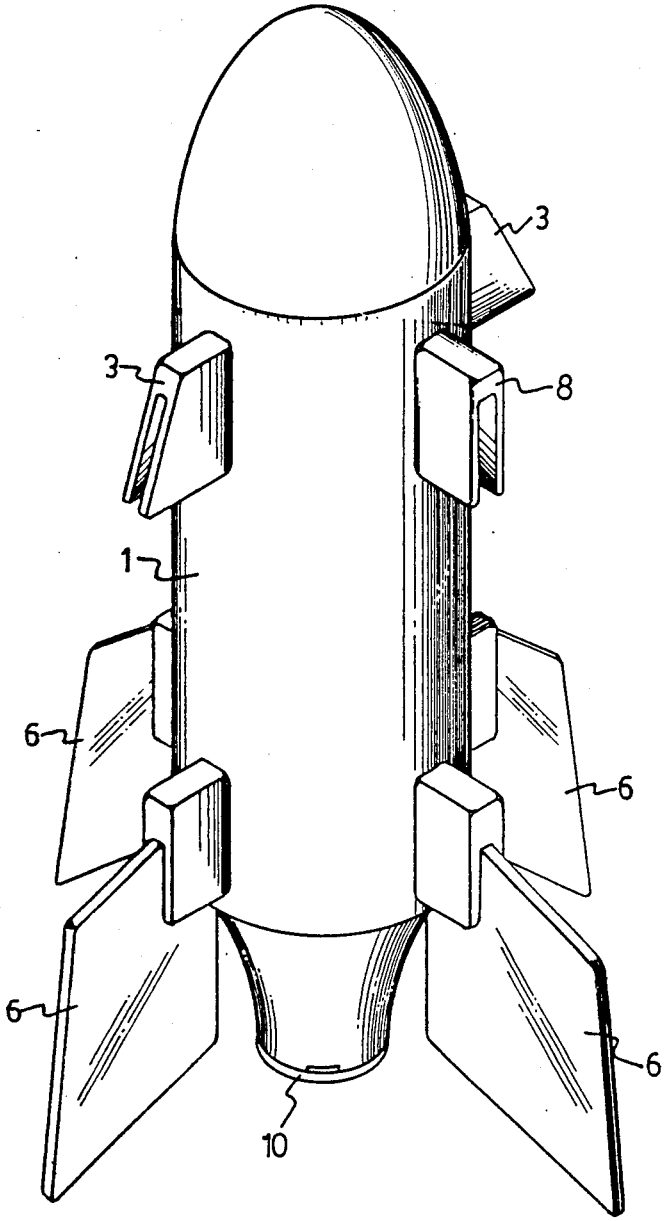
FIG. 4 is a perspective view of a toy rocket constructed from a cleansing liquid dispenser in accordance with the present invention.

Referring ot FIG. 4, it can be seen that if the main body 1 of a used liquid cleanser dispenser is used in conjunction with four tail fins 6, the present invention forms a toy rocket.

Figure 5:
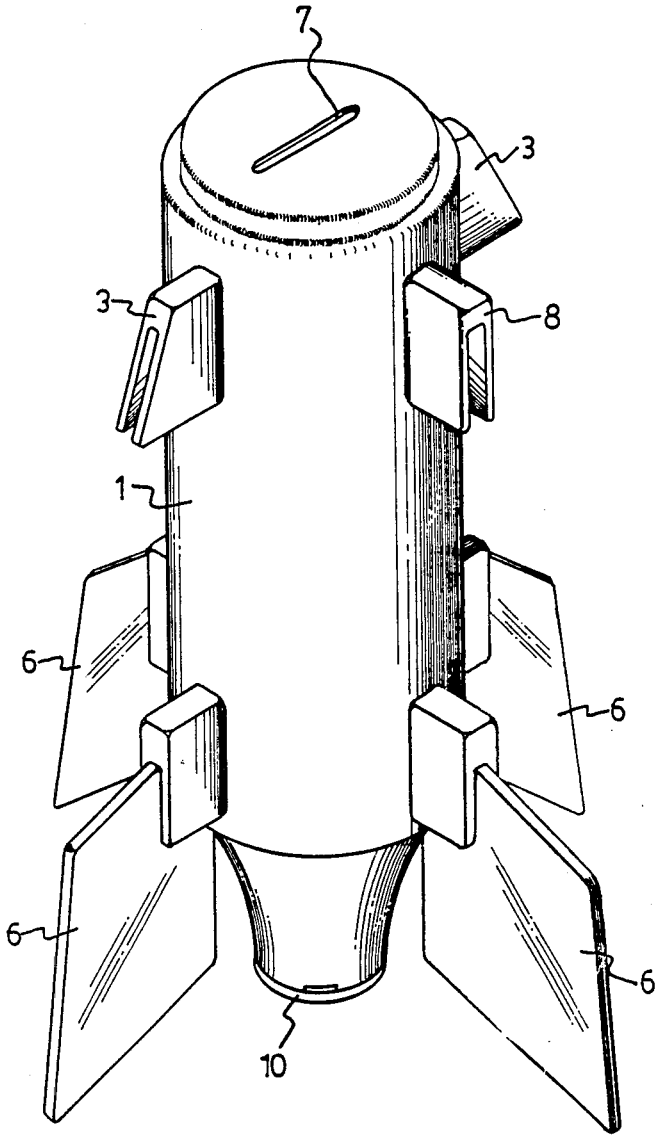
FIG. 5 is a perspective view of a piggy bank constructed from a cleansing liquid dispenser in accordance with the present invention.

Referring to FIG. 5, it can be seen that if the main body 1 of a used liquid cleanser dispenser is used in conjunction with four tail fins 6 and the conical top cover 2 is removed (as shown in FIG. 5), that the present invention forms a piggy bank. Of course, if desired, upper fins (not shown) could be added and the top cover 2 could be placed on the top of the "piggy bank" so as to have the form of a rocket for decorative purposes.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A multi-purpose cleansing liquid dispenser comprising:

(A) a substantially cylindrical main body (1) having a gradually narrowing lower neck (10) on the lower end thereof with an opening for cleansing liquid thereon; said main body (1) having a plurality of evenly spaced vertically oriented lower brackets (4) on a lower outer circumference thereof; at least two upper brackets (3) on an upper outer circumference of said main body (1); a suction cup bracket (8) being set evenly between two of said upper brackets (3);

(B) a conical top cover (2); said top cover (2) frictionally engaging with a circular seat (11) on the top of said main body (1);

(C) a suction cup (9) which engages with the suction cup bracket (8) of the main body (1); said suction cup (9) securing said multi-purpose cleansing dispenser to a wall or the like;

(D) three or four top tail fins (6) which are respectively engageable with a corresponding number of lower brackets (4) so as to respectively partially form either a toy plane or a toy rocket; and (E) two toy wings (5) which are respectively engageable with the upper brackets (3) so as to partially form a toy plane.

* * * * *